US005602628A

United States Patent [19]

Sugiyama et al.

[11] Patent Number: 5,602,628

[45] Date of Patent: Feb. 11, 1997

[54] IMAGE FORMING APPARATUS WITH AUTOMATIC VOLTAGE CONTROL

[75] Inventors: Tsukasa Sugiyama; Yoshiaki Tabata, both of Osaka, Japan

[73] Assignee: Mita Industrial Co., Ltd., Osaka, Japan

[21] Appl. No.: 609,241

[22] Filed: Mar. 1, 1996

[30] Foreign Application Priority Data

Mar. 7, 1995 [JP] Japan ..... 7-046762

[51] Int. Cl.[6] ..... G03G 15/02

[52] U.S. Cl. ..... 399/50; 399/44

[58] Field of Search ..... 355/220, 219, 355/208, 216, 221, 214, 225, 30, 308, 309; 361/225

[56] References Cited

U.S. PATENT DOCUMENTS 5,523,831 6/1996 Rushing ..... 355/208

*Primary Examiner*—Joan H. Pendegrass
*Assistant Examiner*—Quana Grainger
*Attorney, Agent, or Firm*—Beveridge, DeGrandi, Weilacher & Young, LLP

[57] ABSTRACT

The surface of a rotating photoreceptor is charged by main chargers and an electrostatic latent image is formed on the charged surface of the photoreceptor by use of an optical system. The electrostatic latent image is developed into a toner image with toner. The toner image is transferred to a copy sheet at a transfer section and an automatic voltage control is performed to regulate the output voltage of the main chargers so that the surface of the photoreceptor is charged to a predetermined charge when a power switch is turned on. A control unit is provided which performs the automatic voltage control also when the output of an ejection sensing switch representative of the number of image formations is greater than or equal to a predetermined value and the output of a development thermistor is higher than or equal to a predetermined temperature.

8 Claims, 4 Drawing Sheets

IMAGE FORMING APPARATUS WITH AUTOMATIC VOLTAGE CONTROL

BACKGROUND OF THE INVENTION

1. Field of the Invention

The present invention relates to an image forming apparatus such as an electrophotographic copying machine and a printer.

2. Description of the Prior Art

In such image forming apparatuses, when the power is turned on, the photoreceptor drum is rotated and the drum surface is charged by a main charger, and an automatic voltage control is performed to regulate the voltage applied to the main charger so that the surface voltage sensed by a surface voltage sensor is a predetermined surface voltage. The automatic voltage control is performed only when the power is turned on.

In a new image forming apparatus, if the environmental temperature is high, the sensitivity of the drum varies with an increase in the number of image formations. For this reason, if the voltage control is performed only at the power-on, the surface voltage becomes insufficient as the number of image formations increases, so that the image becomes pale.

SUMMARY OF THE INVENTION

An object of the present invention is to provide an image forming apparatus where the surface voltage never remains insufficient even when the image forming apparatus is new.

To achieve the above-mentioned object, according to the present invention, in an image forming apparatus where a surface of a rotating photoreceptor is charged by a main charger, an electrostatic latent image is formed on the charged surface of the photoreceptor by use of an optical system, the electrostatic latent image is developed into a toner image by a toner, the toner image is transferred to a copy sheet at a transfer section, and an automatic voltage control is performed to regulate an output voltage of the main charger so that the surface of the photoreceptor is charged to a predetermined voltage at power-on; the automatic voltage control is also performed when the number of image formations is greater than or equal to a predetermined number of times and an output of a temperature detecting means is higher than or equal to a predetermined temperature.

In this case, when the number of image formations exceeds the predetermined number of times while an image formation of a plurality of copy sheets is being performed, the automatic voltage control is performed after the image formation of a plurality of copy sheets is completed.

According to such features, even if the sensitivity of the drum varies, the automatic voltage control is performed once again to apply a high voltage to the main charger according to the degradation of the sensitivity, so that a desired photoreceptor surface voltage is obtained. The automatic voltage control is also performed when the image forming apparatus is no longer new (i.e. when the variation in the sensitivity becomes almost trivial). In such a case, the minute insufficiency of the voltage is resolved.

When the number of image formations exceeds the predetermined number of times while an image formation of a plurality of copy sheets is being performed, the automatic voltage control is performed after the image formation of the plurality of copy sheets is completed. Then, no problem is caused in the image formation and a desired charging is performed in the next image formation.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
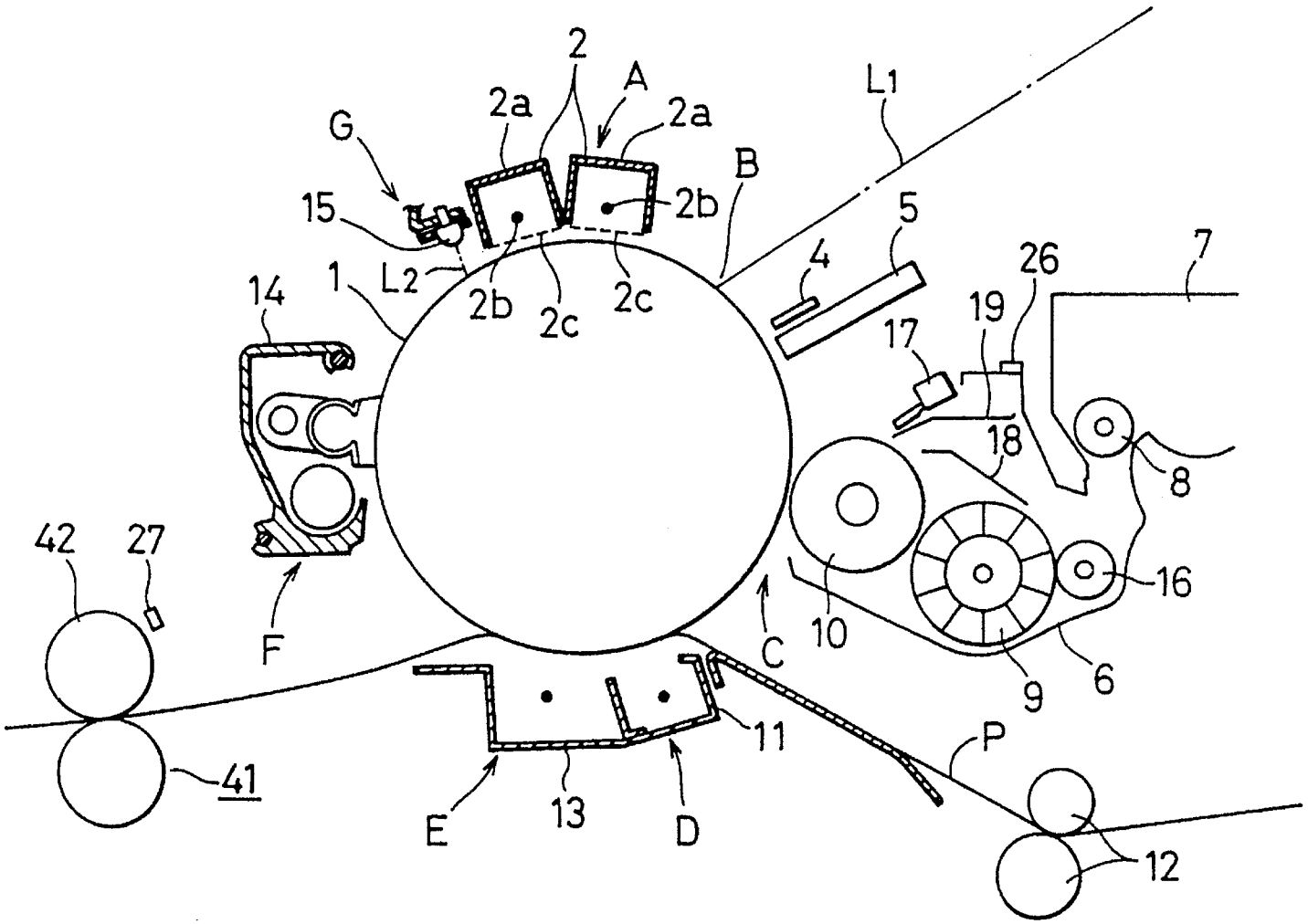
FIG. 1 is a schematic view of an electrographic copying machine embodying the present invention.

Hereinafter, an embodiment in which an apparatus according to the present invention is employed in an electrographic copying machine will be described with reference to the drawings. Referring to FIG. 1, there is schematically shown the structure of the electrographic copying machine. Reference numeral 1 represents a photoreceptor drum acting as an electrostatic latent image carrier. The drum 1 includes a drum base made of a metal such as aluminum on which a photosensitive layer is formed by depositing a selenium photosensitive material, and rotates in the clockwise direction of the figure at a constant speed.

Around the drum 1, the following sections are arranged in this order along the direction of rotation (direction of movement) of the drum 1: a charging section A, an exposure section B, a development section C, a transfer section D, a separation section E, a cleaning section F and a charge removal section G.

In the charging section A, a pair of main chargers 2 are disposed to be adjacent to each other. The main chargers 2 are positioned to look toward the axis of the drum 1 and to be closely opposed to the drum surface. The surfaces of the chargers 2 which are opposed to the drum surface are open. In each of the shield cases 2*a* disposed in parallel with a direction toward the axis of the drum, a main wire 2*b* made of a fine tungsten wire is stretched along the length and a grid electrode 2*c* which is a conductive element having a plurality of openings is disposed at the open surface of the shield case 2*a*.

Typically, the main wires 2*b* have a high voltage of approximately 4 to 6 kV applied thereto. When the high voltage is applied to the main chargers 2, a corona discharge is generated so that a voltage is provided to the drum surface. Normally, the surface voltage of the drum 1 thus charged is approximately 1000 V.

When the drum 1 rotates so that the charged portion of the drum surface reaches the exposure section B, the charged portion is exposed by being irradiated with a reflection light $L_1$ of an original image through a non-illustrated optical system. In this case, only the surface voltage of the exposed portion is optically attenuated and decreases according to the amount of the exposure to form an electrostatic latent image.

A surface voltage sensor 4 is disposed to precede the development section C in the rotation direction of the drum 1. The sensing value of the surface voltage sensor 4 is used in order that the voltage of the drum surface is a target value at the development section C. Since the drum surface charged at the charging section A is dark-decayed while it is moving to the development section C, the surface voltage is reduced to approximately 820 V when the charged portion reaches the development section C.

It is necessary for the surface voltage to be approximately 820 V at the development section C and the voltage applied to the main chargers 2 at the development section is set at a voltage (1000 V) allowing for the dark decay. In other words, in order that the surface voltage of the drum surface at the development section C is the target value 820 V, the surface voltage sensed by the voltage sensor 4 should be 850 V. Therefore, the charging voltage at the charging section A is set so that the sensing value is 850 V, and the voltage is 1000 V.

Reference numeral 5 represents an image erasing blank lamp disposed to be adjacent to the surface voltage sensor 4. The blank lamp 5 includes a light emitting diode (LED) array and erases a part of the electrostatic latent image when it is necessary to do so to specify an image area by selectively turning on a necessary LED so that the portion of the electrostatic latent image irradiated by the LED is optically attenuated.

In the development section C, a developer unit 6 and a toner hopper 7 which supplies toner to the developer unit 6 are disposed. In this arrangement, the toner contained in the toner hopper 7 is supplied into the developer unit 6 by a necessary amount through a sponge roller (toner supplying roller 8), and in the developer unit 6, the non-magnetic toner and magnetic carrier (iron powder) are agitated by an agitating roller 9 to cause the toner held by the carrier to adhere to the surface of a magnetic development roller 10. When the electrostatic latent image formed portion of the drum 1 reaches the development section C, the toner on the developer unit 6 electrically adheres to the drum surface according to the electrostatic latent image through the magnetic development roller 10, thereby forming a toner image. Reference numeral 16 represents a spiral mixing roller.

In the transfer section D, a transfer charger 11 is disposed. When the toner image formed portion of the drum 1 reaches the transfer section D, a sheet P is supplied onto the drum surface via a pair of paper feeding rollers 12 in a paper feeding section, and a voltage of a polarity opposite to that of the toner is applied to the transfer charger 11 to transfer the toner image on the drum surface to the sheet P. In the separation section E, a separating charger 13 is disposed which applies an alternating current electric field to the drum surface to release the sheet P from being attracted by the drum 1 to thereby separate the image transferred sheet P from the drum 1.

In the cleaning section F, a cleaner 14 is disposed. The cleaner 14 scrubs the drum surface to remove things such as toner adhering to the drum surface. The toner remaining on the drum surface reaches the cleaning section F and is scrubbed off by the cleaner 14. At the succeeding charge removal section G, the drum surface is irradiated with a charge removing light $L_2$ from a charge removing lamp 15, so that the surface voltage is optically attenuated to remove the charge.

Then, the drum 1 returns to the charging section A to be ready for the next copy process. In the case of the continuous copying, the above-described copy process is repeated an arbitrary set number of times. In FIG. 1, 2*c* represents a grid electrode of the main charger 2.

Figure 2:
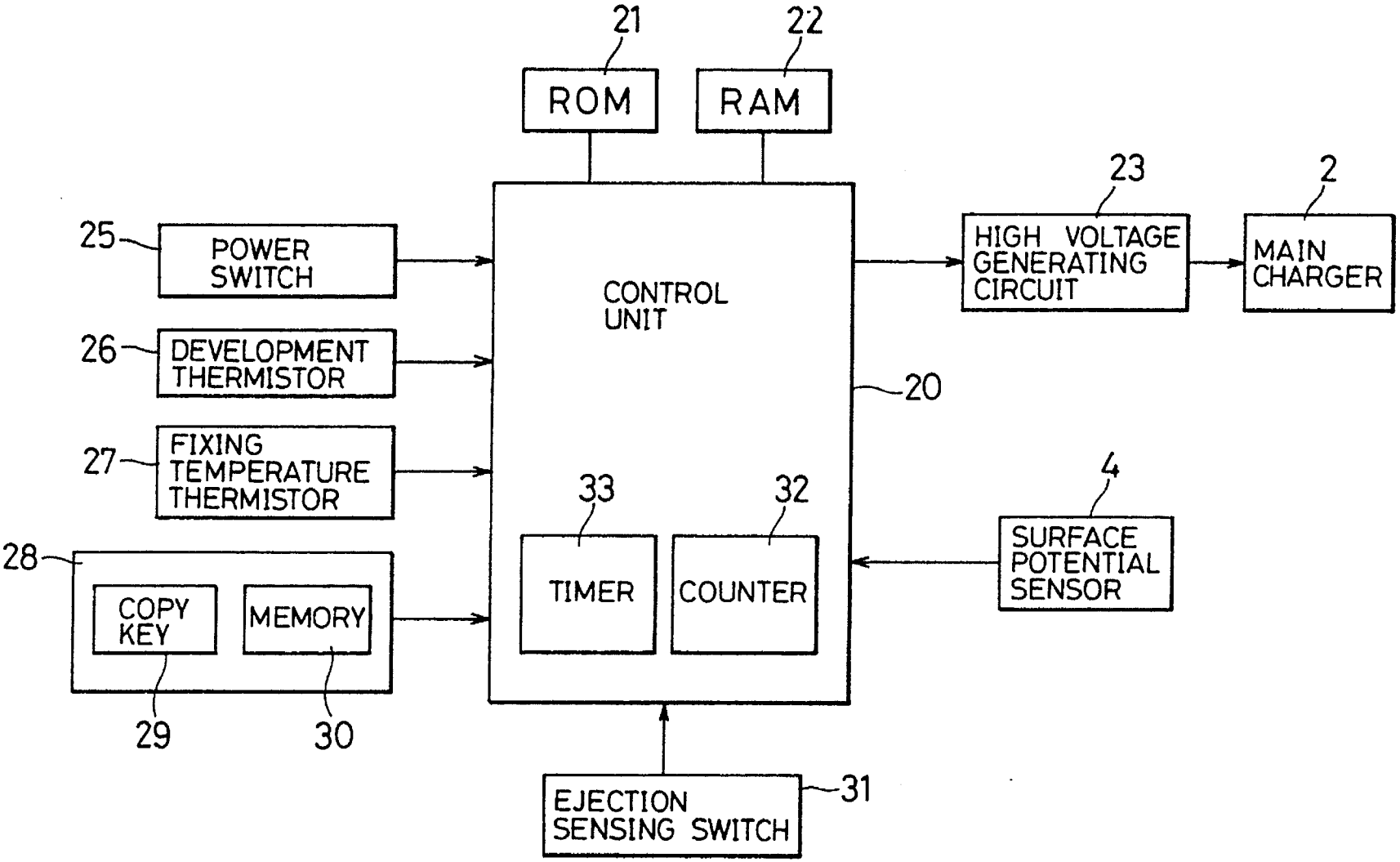
FIG. 2 is a block circuit diagram of the electrographic copying machine embodying the present invention.

Referring to FIG. 2, there is shown a block diagram of a portion of the electrographic copying machine associated with the automatic voltage control. Reference numeral 20 represents a control unit comprising a central processing unit (CPU) of a microcomputer. Reference numeral 21 represents a program storage read only memory (ROM). Reference numeral 22 represents a working random access memory (RAM). Reference numeral 23 represents a high voltage generating circuit which supplies the above-described high voltage to the main chargers 2. Reference numeral 4 represents the surface voltage sensor which is also shown in FIG. 1.

Reference numeral 25 represents a power switch. Reference numeral 26 represents a development thermistor. While the development thermistor is originally provided for determining the temperature of the developer, the present embodiment utilizes the development thermistor for sensing the environmental temperature. Reference numeral 27 represents a fixing temperature thermistor provided in a fixing section 41 (see FIG. 1) for sensing the temperature in the fixing section. Reference numeral 28 represents an operation unit which has a CPU to exchange data with the control unit 20. The operation unit 28 not only has a display and various operation keys such as a copy key 29 but also has a backup memory 30 to store necessary data. Reference numeral 31 represents an ejection sensing switch which senses the ejection of the image transferred sheet.

Figure 3:
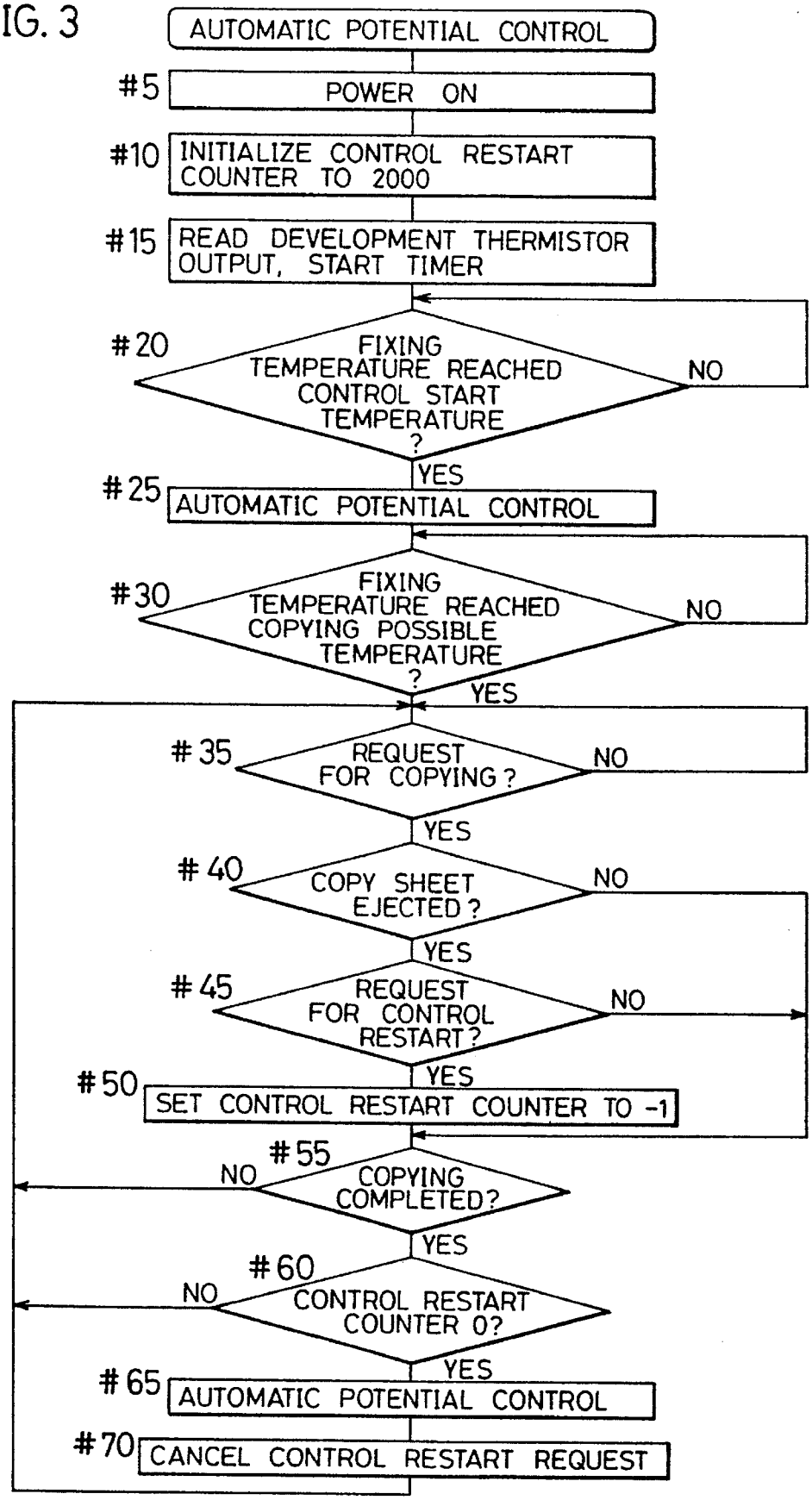
FIG. 3 is a flowchart for an automatic voltage control of the electrographic copying machine.

Hereinafter, the automatic voltage control performed in the present embodiment will be described with reference to the flowchart of FIG. 3. When the power switch 25 is turned on at step #5, the control unit 20 initializes a control restart counter 32 to 2000 at step #10. The control restart counter 32 is to provide a condition to actuate the automatic voltage control after the power-on and the condition is 2000. The condition 2000 means that the number of hitherto copied sheets is 2000. The condition 2000 is stored in the memory 30 of the operation unit and transferred to the control unit 20 at the power-on to be stored in the RAM 22. The condition 2000 is read out from the RAM 32 and used for the initialization of the counter 32.

Then, at step #15, the output of the development thermistor 26 is read into the working RAM 22 as the environmental temperature and a timer 33 is started. The timer 33 is provided for counting the time between the power-on and the stabilization of the electrographic copying machine (approximately 1 second). The timer 33 and the counter 32 are provided in the control unit 20.

At step #20, the process waits until the fixing temperature reaches a control start temperature T1 from the temperature detected by the fixing temperature thermistor 27. When the fixing temperature reaches the temperature T1, the automatic voltage control to be performed at the power-on is performed at step #25. In the automatic voltage control, the output of the surface voltage sensor 4 is compared with a reference value and the difference is applied to the high voltage generating circuit 23 as a control voltage to regulate the voltage applied to the main wires 2*b* of the main chargers 2. The control loop is comprised of a flow of the control unit 20 to the high voltage generating circuit 23 to the main chargers 2 to the photoreceptor drum 1 to the surface voltage sensor 4 to the control unit 20. The above-mentioned reference value is stored in the backup memory 30 of the operation unit 28 and is transmitted from the operation unit 28 to the control unit 20 at the power-on to be stored in the RAM 22. It is read out from the RAM 22 when the comparison with the output of the surface voltage sensor 4 is made.

Then, at step #30, whether the fixing temperature has reached a copy possible temperature T2 or not is determined.

When it has reached T2, the process proceeds to the next step #35. While a concrete example of the temperature T1 at step #20 is 100° C., the temperature T2 at step #30 is 195° C.

At step #35, whether there is a request for copying or not (i.e. whether there is an operation of the copy key 29 or not) is determined. When the request is present, since copying is performed, the process proceeds to step #40 to determine whether the copy sheet has been ejected or not based on the sensing output of the ejection sensing switch 31. When the sheet has not been ejected, the process proceeds to step #55 and when the sheet has been ejected, whether there is a request for a restart of the control or not is determined at step #45.

Figure 4:
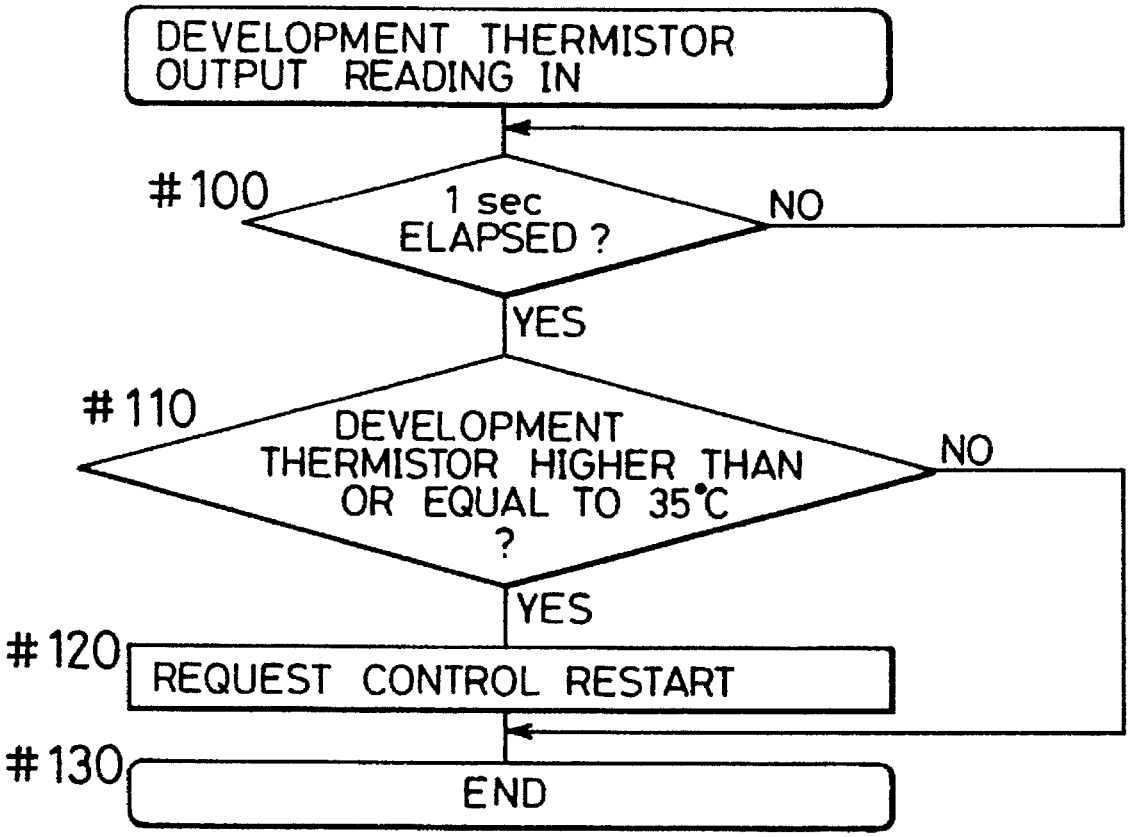
FIG. 4 is another flowchart for the automatic voltage control of the electrographic copying machine.

The request for the restart of the control is fulfilled through another routine as shown in FIG. 4. Referring to FIG. 4, the process waits until one second has elapsed since the start of the timer 33 at step #100 and whether or not the detection value of the development thermistor 26 is higher than or equal to 35° C. is determined at step #110. When it is lower than 35° C., the process proceeds to step #130 to end this routine. When the output is higher than or equal to 35°, the restart of the control is requested at step #120 (specifically, a control restart flag is set) to end this routine.

Returning to FIG. 3, when there is no request for the restart of the control at step #45, the process proceeds to step #55. When the request is present, the counter 32 is decremented by 1 and the process proceeds to step #55.

At step #55, whether copying has been completed or not is determined. When copying has not been completed, the process returns to step #35. When copying has been completed, the process proceeds to step #60 to determine whether the count value of the counter 32 is 0 or not (i.e. whether the counter 32 has counted to 2000 or not) is determined. When the count value is not 0, the process returns to step #35. When the count value is 0, the process proceeds to step #65 to perform the automatic voltage control. Then, at step #70, the control restart request is canceled and the process returns to step #35.

Thus, in the present embodiment, the automatic voltage control is performed once again (steps #60 and #65) only when the temperature at the development thermistor 26 is higher than or equal to 35° C. (steps #15 and #110) and the number of copied sheets reaches 2000. Therefore, even if the electrographic copying machine is new, an excellent charging voltage is always obtained to prevent the image from being undesirably pale. The data value of a high voltage generating circuit driving signal obtained in the automatic voltage control (i.e. the voltage applied to the main chargers) is stored in the RAM 22 and used for copy processes performed thereafter.

This data is rewritten when the automatic voltage control is performed in a copy process performed thereafter. While in the above-described embodiment, the voltage applied to the main wires 2*b* of the main chargers 2 is regulated by the high voltage generating circuit 23, regulating the voltage applied to the grid electrodes of the main chargers 2 produces the same result. This is because in either case, the output voltage of the main chargers 2 is regulated as a consequence to thereby regulate the surface voltage of the photoreceptor drum 1. When the total number of copied sheets reaches 2000 while copying of a plurality of sheets is being performed, the automatic voltage control may be performed after the copying of a plurality of sheets is completed.

As described above, according to the present invention, the problem faced by the prior art that the image becomes pale with the increase in the number of image formations after the power-on is solved even in a new image forming apparatus. Thus, the present invention is effective, in particular, on high speed copying machines which perform a large quantity of copying a day.

Obviously, many modifications and variations of the present invention are possible in light of the above teachings. It is therefore to be understood that within the scope of the appended claims, the invention may be practiced other than as specifically described.

What is claimed is:

1. An image forming apparatus where a surface of a rotating photoreceptor is charged by a main charger, an electrostatic latent image is formed on the charged surface of the photoreceptor by use of an optical system, the electrostatic latent image is developed into a toner image with a toner, the toner image is transferred to a copy sheet at a transfer section, and an automatic voltage control is performed to control an output voltage of the main charger so that the surface of the photoreceptor is charged to a predetermined voltage at power-on, wherein the automatic voltage control is also performed when, after power-on, the number of image formations is greater than or equal to a predetermined number of times and an output of a temperature detecting means is higher than or equal to a predetermined temperature.

2. An image forming apparatus according to claim 1, wherein when the number of image formations exceeds the predetermined number of times while an image formation of a plurality of copy sheets is being performed, the automatic voltage control is performed after the image formation of the plurality of copy sheets is completed.

3. An image forming apparatus comprising:

a photoreceptor drum which rotates;

a main charger which charges the photoreceptor drum;

a developer unit which develops with a toner an electrostatic latent image formed on a charged surface of the photoreceptor drum;

transferring means for transferring a toner image formed on the surface of the photoreceptor drum by the development onto a sheet of paper;

separating means for separating the toner image transferred sheet of paper from the surface of the photoreceptor drum;

a high voltage generating circuit which applies a high voltage to the main charger;

temperature detecting means installed in the image forming apparatus;

controlling means for controlling the high voltage generating circuit so that a charging voltage of the surface of the photoreceptor drum is a predetermined voltage when power of the image forming apparatus is turned on and when the number of image formations performed after the power-on has reached a predetermined number and an output of the temperature detecting means is higher than or equal to a predetermined temperature.

4. An image forming apparatus according to claim 3, wherein a surface voltage sensor which detects a surface voltage of the photoreceptor drum is provided immediately in front of the developer unit, and wherein said controlling means controls the high voltage generating circuit so that an output of the surface voltage sensor is a predetermined voltage.

5. An image forming apparatus according to claim 3, wherein said temperature detecting means is a thermistor installed in the developer unit.

6. An image forming apparatus according to claim 3, wherein said controlling means comprises a microcomputer.

7. An image forming apparatus according to claim 6, wherein said controlling means has a counter which decrements an initial value every time an output of a sheet ejection switch is counted, and wherein said counter is initialized at the power-on.

8. An image forming apparatus according to claim 7, wherein an operation unit having a first memory in which data on the predetermined number is stored is connected to the controlling means, and wherein at the power-on, the data on the predetermined number is transferred from the first memory to a second memory of the controlling means and the counter is initialized based on the data on the predetermined number outputted from the second memory.

* * * * *